US005516237A

United States Patent [19]

Hebant

[11] Patent Number: 5,516,237

[45] Date of Patent: May 14, 1996

[54] PROCESS TO ANCHOR A POST OR A STRING OF POSTS IN THE GROUND, AND ANCHORING PIER OF A POST OR A STRING OF POSTS PRODUCED BY THE PRACTICE OF THIS PROCESS

[75] Inventor: Nicolas Hebant, Bois-Colombes, France

[73] Assignee: Spie Fondations, Cergy Pontoise, France

[21] Appl. No.: 234,834

[22] Filed: Apr. 28, 1994

[30] Foreign Application Priority Data

Apr. 28, 1993 [FR] France ..... 93 05017

[51] Int. Cl.[6] ..... E02D 5/30

[52] U.S. Cl. ..... 405/233; 405/232; 405/240; 405/133

[58] Field of Search ..... 405/235–243, 405/231–233, 133; 52/297

[56] References Cited

U.S. PATENT DOCUMENTS

| | | | |
|---|---|---|---|
| 839,829 | 1/1907 | Fell | 52/297 |
| 890,765 | 6/1908 | Gilbreth | 405/239 X |
| 1,113,558 | 10/1914 | Illingworth | 52/297 X |
| 1,665,795 | 4/1928 | Sipe | 405/239 |
| 1,681,883 | 8/1928 | Sipe | 405/239 |
| 2,488,073 | 11/1949 | Thornley et al. | 405/239 |
| 3,579,936 | 5/1971 | Andersson | 52/297 |
| 4,116,012 | 9/1978 | Abe et al. | 405/238 |
| 4,793,110 | 12/1988 | Tucker | 52/297 |

FOREIGN PATENT DOCUMENTS

| | | |
|---|---|---|
| 363044 | 7/1981 | Austria . |
| 2222302 | 11/1973 | Germany . |
| 60-238516 | 11/1985 | Japan . |

*Primary Examiner*—Dennis L. Taylor
*Attorney, Agent, or Firm*—Young & Thompson

[57] ABSTRACT

There is dug in the ground (2) by means of a digging tool, a hole in which is sunk at the same time and progressively a hollow prefabricated casing element (5) of corresponding shape. When the hole has the depth necessary to receive completely the hollow casing element (5), the digging tool is retreated, leaving in place the hollow casing element (5). Anchoring elements for the post (11) are introduced within the hollow casing element (5), as well as prefabricated leveling elements (14); and there is injected into the bottom of the hole a fluent material (18) capable of hardening to anchor within the ground (2) the prefabricated leveling elements (14) and the anchoring elements for the post (11). The post can thereafter be inserted, or the post can be inserted before the leveling elements and hardenable material are emplaced.

5 Claims, 2 Drawing Sheets

PROCESS TO ANCHOR A POST OR A STRING OF POSTS IN THE GROUND, AND ANCHORING PIER OF A POST OR A STRING OF POSTS PRODUCED BY THE PRACTICE OF THIS PROCESS

FIELD OF THE INVENTION

The present invention relates to a process to anchor a post or a string of posts in the ground.

The present invention also relates to an anchored post or string of posts in the ground produced by the practice of said process.

BACKGROUND OF THE INVENTION

The conventional process to anchor a post in the ground comprises the steps consisting of digging a hole in the ground, introducing into this hole anchoring elements for the post, adjusting the position of these anchoring elements, then emplacing a sealing material, for example fluent concrete, in the hole to anchor said anchoring elements in the ground, finally, as the case may be, securing the post on the anchoring elements. In the particular case of posts supporting the overhead wires along a railway, it is known to use a special train which moves along the railway and transports the equipment necessary for the preparation of fluent concrete which is poured into the foundation holes, each hole receiving but a small volume of concrete, and the anchoring piers of the posts being often identical.

Such a process is always very costly. Moreover, its practice, if it does not prove troublesome along a new railway which is not yet in service, gives rise to considerable inconvenience to traffic in the case in which an existing line in service is electrified.

In all cases, the preparation of fluent concrete to cast the foundation piers give rise to difficulties, particularly in the field far from centers for the preparation and distribution of fluent concrete.

SUMMARY OF THE INVENTION

The present invention has for its object to overcome the drawbacks of the known processes and to provide a process of the above type permitting anchoring posts in the ground under excellent conditions of efficiency, safety and cost, this process being particularly well adapted to anchoring strings of posts in the field and not requiring the use of heavy equipment of the type of the mentioned concrete train.

The process of the above type contemplated by the invention comprises the following operations:

- there is dug in the ground by digging means a hole into which is lowered at the same time and progressively a prefabricated hollow casing element of corresponding shape;
- when the hole has the depth necessary to receive completely said hollow casing element, the digging means are withdrawn leaving in place the hollow casing element;
- there are introduced anchoring elements for the posts then there is emplaced a sealing material within the hollow casing element to anchor said anchoring elements in the ground after having adjusted the position of these latter, finally, as the case may be, the posts are secured to the anchoring elements.

According to the invention, this process is characterized in that there is introduced within the hollow casing element prefabricated leveling elements, and there is injected into the bottom of the hole a fluent material capable of hardening to anchor within the ground said prefabricated leveling elements and the anchoring elements of the post.

The hole thus provided with the prefabricated anchoring element can remain open for a long time before the emplacement of the sealing material. The operation of emplacing sealing material is thus completely independent of that of digging the holes, and can be arranged in advance in a manner adapted optimally to the number of holes to be treated and to the situation of these latter.

The principal elements constituting the anchoring pier, and in particular the prefabricated leveling elements, can thus be prefabricated in the factory, for example of concrete, under optimum conditions for preparation of the concrete mixture, for casting and hardening this concrete, for controlling the quality of these elements. It thus suffices to transport these prefabricated elements to the utilization site with means or vehicles, for example trucks or train cars, which are the most appropriate or the most readily available. The operation of emplacing the sealing material at the site is thus limited to the injection of fluent material capable of hardening, and is entirely independent of the preceding operations.

According to a second aspect of the invention, the process to anchor a string of posts in the ground by practicing the above process is characterized in that it comprises the following steps:

- progressively digging the various holes in each of which is left in place the corresponding hollow prefabricated casing element;
- emplacing successively for each post the anchoring elements and the corresponding prefabricated leveling elements;
- injecting successively at the bottom of each of the holes the fluent material capable of hardening.

In the case of the electrification of a rail line in service, there is thus completely avoided the need for a concrete train of the mentioned type.

According to a third aspect of the present invention, the anchoring pier for a post in the ground according to the invention is characterized in that it comprises, within a hole in the ground, a tubular casing element within which are disposed anchoring elements, as well as prefabricated leveling elements, between which has been injected a material capable of hardening. It is preferably produced by the practice of the preceding process.

Other features and advantages of the invention will become apparent from the detailed description hereinafter.

BRIEF DESCRIPTION OF THE DRAWINGS

In the accompanying drawings, given solely by way of nonlimiting example.

DESCRIPTION OF THE PREFERRED EMBODIMENTS

Figure 1:
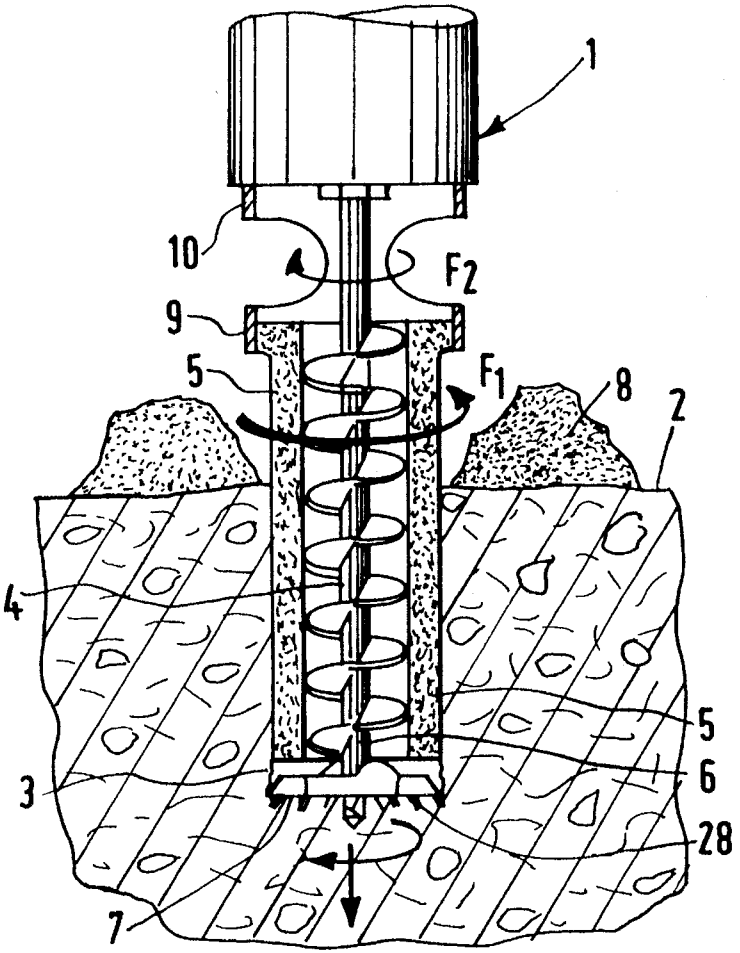
FIG. 1 is a fragmentary cross-sectional schematic view of a device according to the second aspect of the invention for practicing the process of the invention.

In the embodiment of FIG. 1, the device 1 permits the practice of the process of the invention, which is a process to anchor a post in the ground 2, comprising the steps of digging a hole 3 in the ground 2, introducing into this hole 3 anchoring elements for the post, adjusting the position of these anchoring elements, then emplacing a sealing material, concrete or the like, in the hole 3 to anchor said anchoring elements in the ground 2, finally, as the case may be, securing the post to the anchoring elements.

According to the invention, this process comprises the following operations:

digging in the ground 2 by means of a drilling tool 4, a cylindrical hole 3 into which is sunk at the same time and progressively a prefabricated tubular casing element 5;

when the hole 3 has the depth necessary completely to receive said tubular casing element 5, the drilling tool 4 is withdrawn leaving in place the tubular casing element 5;

said anchoring elements for the post are introduced and the sealing material is emplaced within the tubular casing element 5.

In the illustrated embodiment, there is used as a drilling tool an auger 4 of helicoidal shape having at its free end 6 at least one cutting tool 7, and the auger 4 is turned in the direction $F_1$ and the tubular casing element 5 in the opposite direction $F_2$ to raise to the surface of the ground 2 the drilling debris 8.

Turning the tubular casing 5 in the direction $F_2$ opposite the direction of rotation $F_1$ of the auger 4, facilitates on the one hand the evacuation of the debris 8, on the other hand the progressive descent of the casing 5 within the hole 3.

The prefabricated tubular casing 5 can be of concrete, reinforced or not, of steel or any other material. It is designed to be driven in rotation, with for example its upper portion of external polygonal shape, for example hexagonal, schematically shown at 9.

The auger 4 and the casing 5 are driven by a rotation head schematically shown at 10, which is of any known type, and is carried by a hoist engine not shown of any known type, for example a crane head mounted on a vehicle.

According to the process of the present invention, once the hole 3 is made and the casing 5 is in place in said hole 3, there is introduced within the tubular casing 5 prefabricated leveling elements, of concrete or the like, and there is injected into the bottom of the hole 3 a fluent material capable of hardening to anchor in the ground said prefabricated leveling elements and the anchoring elements of the post.

Figure 2:
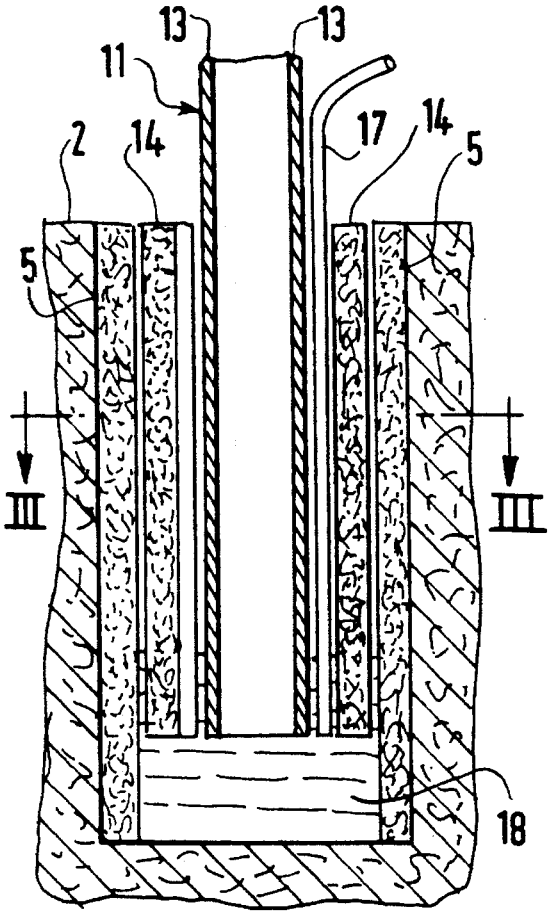
FIG. 2 is a view similar to FIG. 1, in cross section on the line II—II in FIG. 3, showing an anchoring pier produced by the practice of a first embodiment of the process according to the invention.
Figure 3:
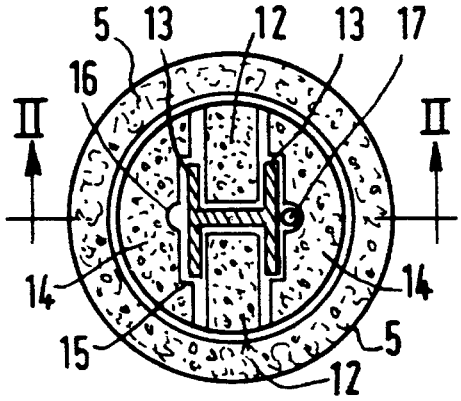
FIG. 3 is a cross section on the line III—III of FIG. 2.

In the embodiment shown in FIGS. 2 and 3, the post 11 has a transverse cross section of H shape and is adapted to be introduced directly into the interior of the tubular casing 5.

It will be seen that there is introduced within the tubular casing 5 about the post 11 several prefabricated leveling elements before injecting the fluent material capable of hardening.

There are thus introduced about the post 11 two elements 12 of substantially rectangular section entering between the flanges 13 of post 11 of H shape, and two elements 14 of cylindrical sector and having on their surface adjacent the post 11 a recess 15 receiving the flanges 13 and a throat 16 permitting introducing a tube 17 for the injection of the sealing material 18. The leveling elements 12, 14 are prefabricated of concrete or the like.

The number and the shape of the elements 12, 14 can of course be different from those described.

Figure 4:
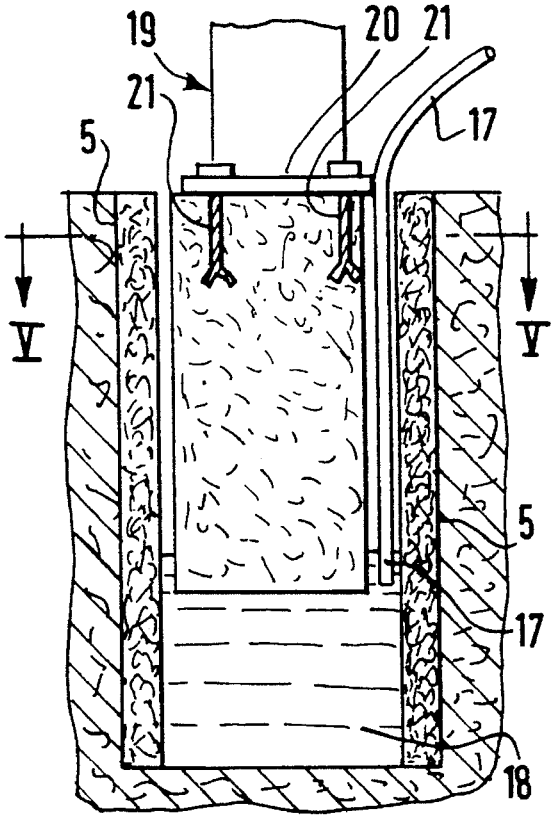
FIG. 4 is a view similar to FIG. 2, in section on the line IV—IV in FIG. 5, corresponding to another embodiment of the process of the invention.
Figure 5:
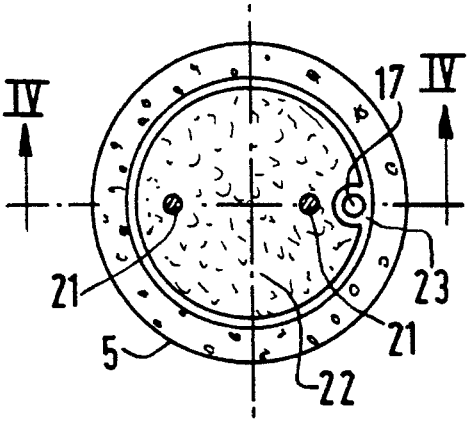
FIG. 5 is a cross-sectional view on the line V—V in FIG. 4.

In the embodiment shown in FIGS. 4 and 5, the post 19 has a transverse cross section of any shape and comprises at its base an anchoring plate 20 adapted to be secured to anchoring rods 21. It will be seen that there has been introduced within the tubular casing 5 a single leveling block 22, within which are embedded said anchoring rods 21. The block 22 comprises at its periphery a throat 23 for the passage of the tube 17 for injection of the fluent sealing material 18.

In the two cases described, the sealing of the post 11, 19 is effected by filling the voids between the casing 5, the prefabricated elements 22, 12, 14 and as the use may be the post 11 with a conventional fluent sealing product, cement, mortar, resin, etc. adapted to harden. It suffices to lower the tube 17 within the throat 16, 23, to the base of the elements to be sealed and to inject the sealing mixture 18 which rises within the casing 15 to fill the voids.

During the operation of emplacing the prefabricated casing 5, it is also possible to inject at the periphery of this latter a mixture adapted for the sealing of this latter within the ground. This sealing can be effected for example with cement or a mixture of bentonite and cement or the like.

All these operations can be performed even if the interior of the casing 5 is full of water or mud. The prefabricated elements 22, 12, 14 are placed within the casing 5 with sufficient play which permits the ultimate adjustment of the final position of the post before sealing.

Figure 6A:
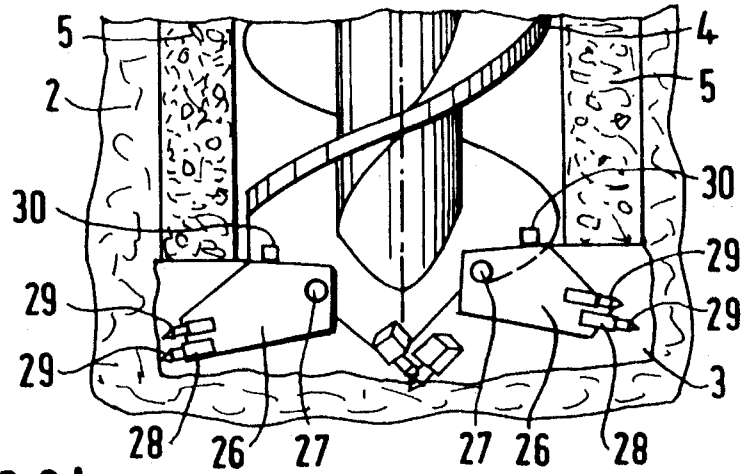
FIGS. 6A and 6B are enlarged views of the detail of FIG. 1, showing the cutting tools respectively in the cutting position and in the retracted position.
Figure 6B:
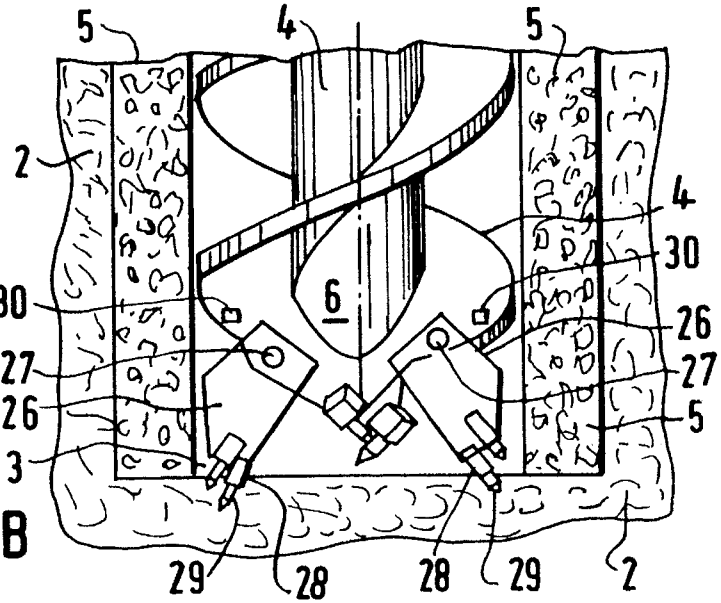

In the embodiment of FIGS. 6A and 6B, the boring tool is an auger 4 of helicoidal shape of an external diameter adapted to fit within the internal diameter of the prefabricated casing 5. This auger comprises at its lower end 6 several cutting tools 7 mounted so as to be movable between a cutting position shown in FIG. 6A and permitting digging a hole of a diameter adapted to receive the external diameter of the prefabricated casing 5, and a retracted position shown in FIG. 6B and permitting the passage of the cutting tools 7 within said prefabricated casing 5 during the removal of the auger 4 once the hole 3 has achieved the required depth.

In this example, each cutting tool 7 comprises a plate 26 mounted pivotally about an axle 27 fixed at the lower end 6 of the auger 4 and passing through the plate 26 adjacent to its rear end. At its forward end opposite the axle 27, the plate 26 carries one or several cutting fingers 28 each comprising in known manner an end constituted by a point 29 of a hard material such as carbide. Detents 30 are provided to block the plates 26 in their cutting position (see FIG. 6A). The orientation of the fingers 28 relative to the plate 26, the number of plates and the number of fingers per plate can be as desired.

Generally speaking, the dimensions, structure and characteristics of the hollow casing 5 can be predetermined, and in particular the reinforcing members of this element can be calculated when it is of reinforced concrete, such that it can support by itself the reaction forces transmitted by the post 11, 19. Under these conditions, the prefabricated leveling elements 12, 14, 22 are designed so as to receive and transmit only the compressive forces, and are produced for example of unreinforced concrete, very economically. The hollow prefabricated casing 5 thus forms an integral part of the anchoring pier structure of which it constitutes the resistive element.

Of course, the invention is not limited to the embodiments which have been described, and numerous modifications and variations can be imparted to these latter without departing from the scope of the invention.

Thus, all that which has been said above in connection with a hole 3, the prefabricated casing 5 and prefabricated leveling elements 12, 14, 22, is applicable also to the case in which these elements have a figure of rotation, particularly truncated conical, and as the case may be, for the process, a shape which will not be one of revolution. The materials described could be changed.

Likewise, the swinging of the plates 26 could be controlled, for example hydraulically.

I claim:

1. Process to anchor a post in the ground, comprising:

a) determining a digging direction;

b) supporting a prefabricated elongated hollow casing element of a generally cylindrical shape with its longitudinal axis in the digging direction;

c) introducing into the casing element digging means having a longitudinal axis parallel to the digging direction;

d) digging a hole in the ground by driving the digging means in a first direction of rotation, and substantially simultaneously, sinking the casing element in the hole by driving said casing element in a second direction of rotation opposite to the first direction, thereby facilitating evacuation of debris removed from the ground by the digging means from the casing element and the hole;

e) withdrawing the digging means while leaving in place the hollow casing element, when the hole has a depth sufficient to receive a determined length of said hollow casing element;

f) introducing into the hole a post and anchoring elements for the post, and securing the post to said anchoring elements;

g) introducing within the hollow casing element prefabricated leveling elements; and h) injecting into the bottom of the hole and around the leveling elements, a fluent material capable of hardening, so as to anchor within the casing elements the prefabricated leveling elements, the anchoring elements and the post.

2. A process according to claim 1, wherein the digging means is an auger of helicoidal shape having at its free end at least one cutting tool.

3. A process according to claim 1, wherein the prefabricated leveling elements are introduced within the hollow casing element before injecting the fluent material capable of hardening.

4. A process according to claim 1, further comprising introducing within the casing element at least one prefabricated leveling block having embedded therein anchoring rods, and wherein the post comprises at its base an anchoring plate adapted to be fixed to said anchoring rods.

5. A process to anchor a string of posts in the ground by practicing the process according to claim 1, which comprises producing successively a spaced plurality of said holes in each of which is left in place the corresponding hollow prefabricated casing element;

emplacing successively for each post the anchoring elements and the corresponding prefabricated leveling elements; and injecting successively into the bottom of each of the holes the fluent material capable of hardening.

* * * * *